US006612771B1

(12) United States Patent
Su

(10) Patent No.: US 6,612,771 B1
(45) Date of Patent: Sep. 2, 2003

(54) LOOSE LEAF BINDING DEVICE

(76) Inventor: Ken-Jui Su, 180, First Shu Wang Rd., Da Li City, Taichung Hsien (TW)

( * ) Notice: Subject to any disclaimer, the term of this patent is extended or adjusted under 35 U.S.C. 154(b) by 0 days.

(21) Appl. No.: 10/330,395

(22) Filed: Dec. 27, 2002

(51) Int. Cl.[7] ..... B42F 3/06

(52) U.S. Cl. ..... 402/57; 150/118; 150/143; 150/149; 150/152; 206/425; 229/67.4; 281/15.1; 281/51; 402/73; D19/26

(58) Field of Search ..... 402/57, 73, 80 R, 402/500, 502; 281/15.1, 21.1, 29, 30, 31, 36, 37, 38, 51; 206/425; 229/67.1, 67.3, 67.4, 82, 84; D19/26, 27; 150/118–123, 132, 143, 149, 152

(56) References Cited

U.S. PATENT DOCUMENTS 1,585,051 A * 5/1926 Skoglund ..... 206/39.4
2,687,159 A * 8/1954 Dobbs et al. ..... 150/151
3,232,397 A * 2/1966 McCoy ..... 190/110
D388,822 S * 1/1998 Frank ..... D19/27
6,182,827 B1 * 2/2001 Su ..... 206/425
6,241,087 B1 * 6/2001 Moorhouse, Sr. ..... 206/308.1
6,394,497 B1 * 5/2002 Ho ..... 281/29
6,502,742 B1 * 1/2003 Su ..... 229/67.3
2002/0179475 A1 * 12/2002 Kohana ..... 206/425

* cited by examiner

*Primary Examiner*—Monica Carter
(74) *Attorney, Agent, or Firm*—Alan D. Kamrath; Rider Bennett, LLP.

(57) ABSTRACT

A loose-leaf binding device has a first binder, a second binder, a plurality of sheets of loose-leaf paper disposed between the first binder and the second binder, and a coiled ring fastening the first binder, each sheet of loose-leaf paper, and the second binder. The first binder has an oblong hole and a round hole. The second binder has an oblong slot to match the oblong hole of the first binder. A pleated flap is connected to the second binder. The pleated flap has a first crease and a second crease. The pleated flap is inserted in the oblong hole of the first binder.

5 Claims, 5 Drawing Sheets

LOOSE LEAF BINDING DEVICE

BACKGROUND OF THE INVENTION

The present invention relates to a loose-leaf binding device. More particularly, the present invention relates to a loose-leaf binding device which has a bag to hold a pen.

A conventional loose-leaf binder does not a handle portion to be caried conveniently. The conventional loose-leaf binder does not have a bag to hold a pen.

SUMMARY OF THE INVENTION

An object of the present invention is to provide a loose-leaf binding device which has a bag to hold a pen.

Another object of the present invention is to provide a loose-leaf binding device which has an oblong hole and an oblong slot to form handle portions in order to carry the loose-leaf binding device conveniently.

Accordingly, a loose-leaf binding device comprises a first binder, a second binder, and a coiled ring fastening the first binder and the second binder. The first binder has an oblong hole and a round hole. The second binder has an oblong slot to match the oblong hole of the first binder. A pleated flap is connected to the second binder. The pleated flap has a first crease and a second crease. The pleated flap is inserted in the oblong hole of the first binder.

In accordance with a first preferred embodiment of the present invention, a loose-leaf binding device comprises a first binder, a second binder, a plurality of sheets of loose-leaf paper disposed between the first binder and the second binder, and a coiled ring fastening the first binder, each sheet of loose-leaf paper, and the second binder. The first binder has an oblong hole and a round hole. The second binder has an oblong slot to match the oblong hole of the first binder. A pleated flap is connected to the second binder. The pleated flap extends, toward an inner face of the second binder. The pleated flap has a first crease and a second crease. The pleated flap is inserted in the oblong hole of the first binder. A first fastener is disposed on the second binder. A second fastener is disposed on the pleated flap to match the first fastener. A connection plate is disposed on the second binder. A bag is connected to the connection plate.

In accordance with a second preferred embodiment of the present invention, a loose-leaf binding device comprises a first binder, a second binder, a plurality of sheets of loose-leaf paper disposed between the first binder and the second binder, and a coiled ring fastening the first binder, each sheet of loose-leaf paper, and the second binder. The first binder has an oblong hole and a round hole. The second binder has an oblong slot to match the oblong hole of the first binder. A pleated flap is connected to the second binder. The pleated flap extends toward an outer face of the second binder. A first fastener is disposed on the second binder. A second fastener is disposed on the pleated flap to match the first fastener. A connection plate is disposed on the second binder. A bag is connected to the connection plate.

DETAILED DESCRIPTION OF THE INVENTION

Figure 1:
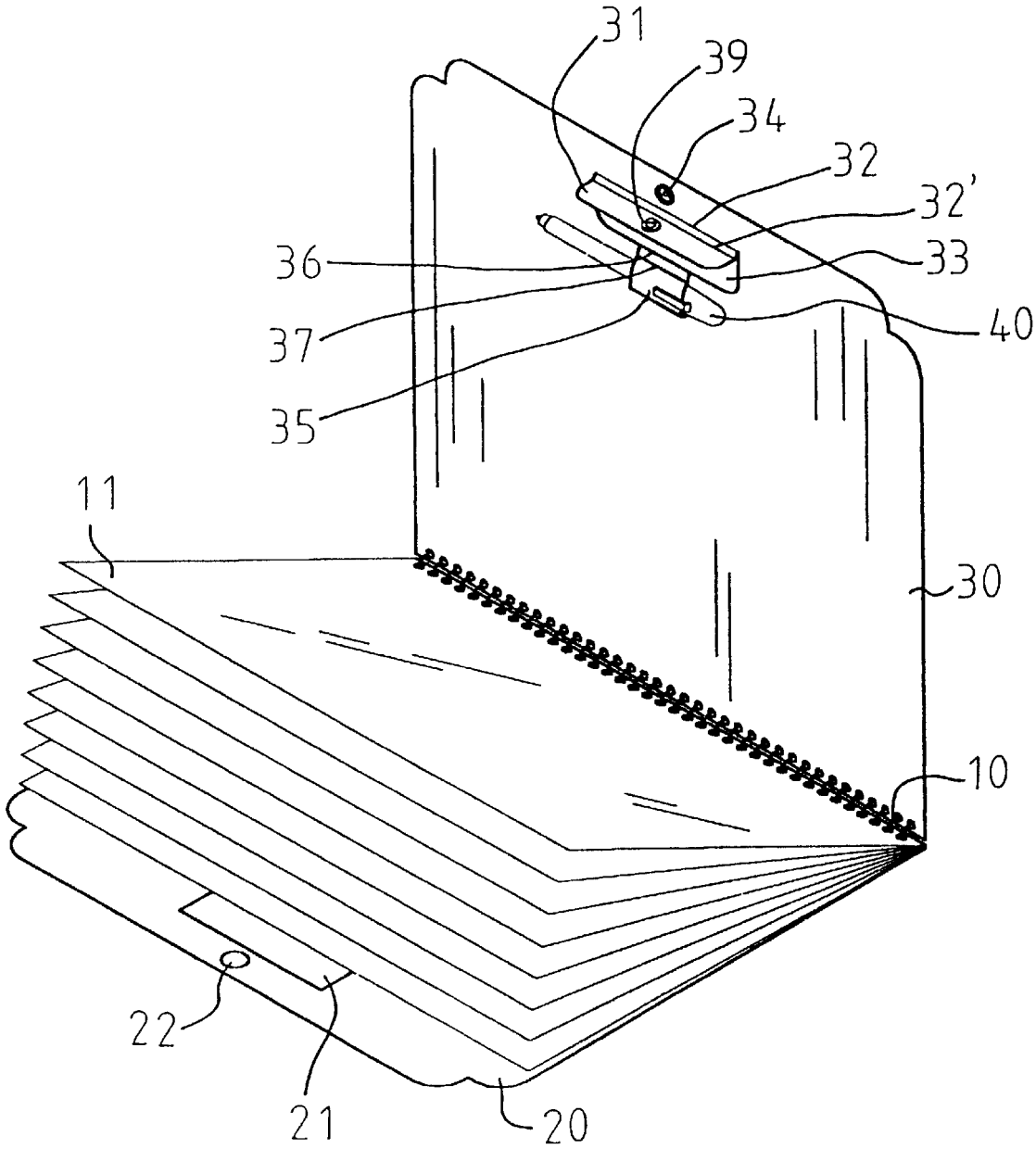
FIG. 1 is a perspective view of a loose-leaf binding device of a first preferred embodiment in accordance with the present invention while the loose-leaf binding device is opened.
Figure 2:
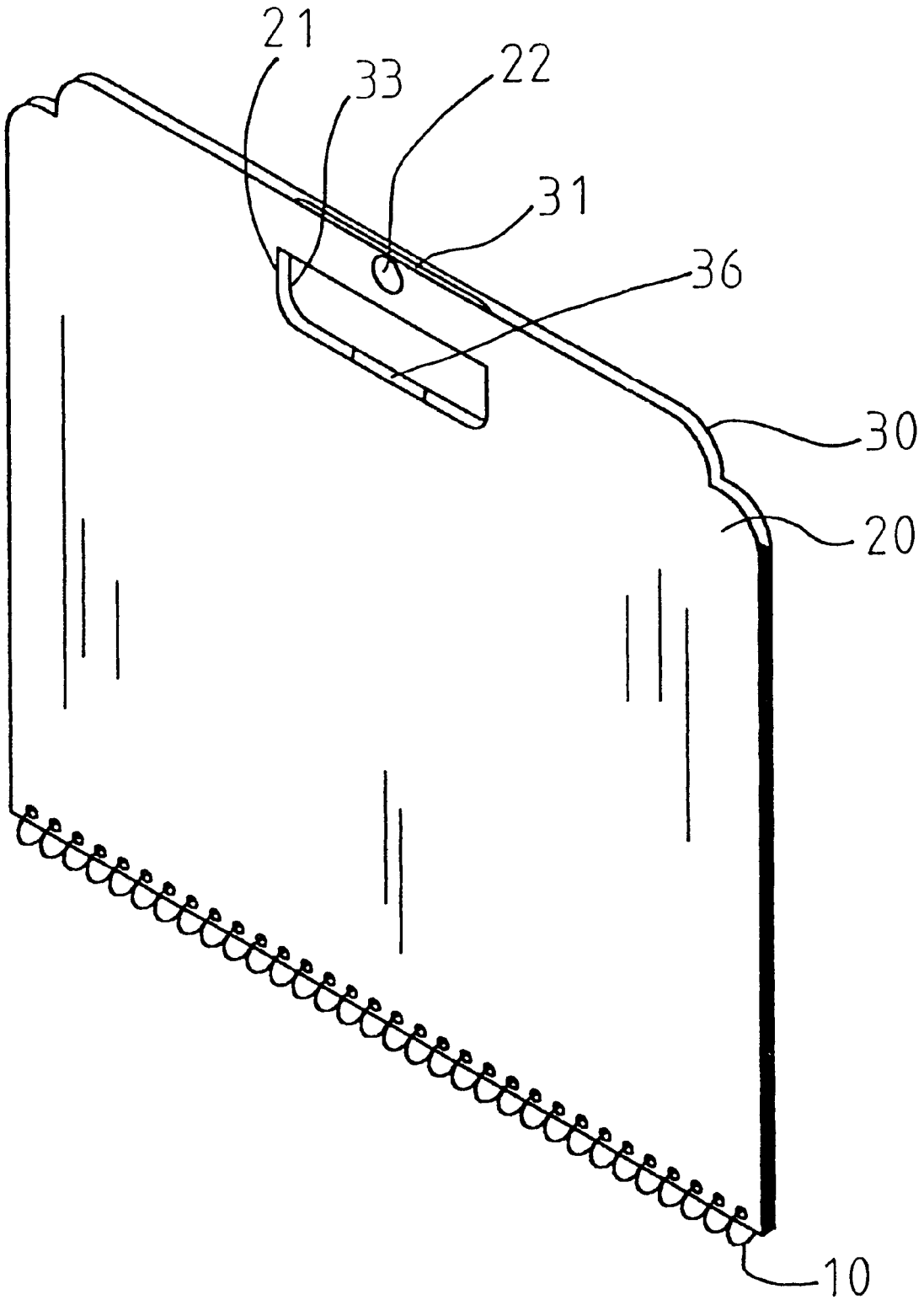
FIG. 2 is a perspective view of a loose-leaf binding device of a first preferred embodiment in accordance with the present invention while the loose-leaf binding device is closed.
Figure 3:
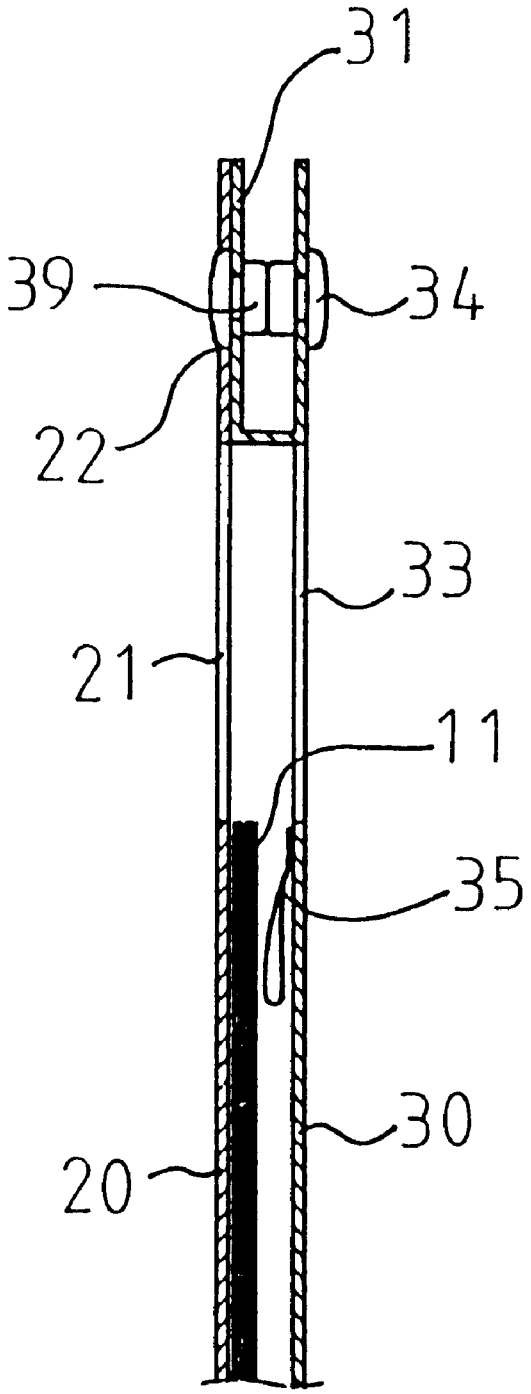
FIG. 3 is a sectional view of FIG. 2.

Referring to FIGS. 1 to 3, a first loose-leaf binding device comprises a first binder 20, a second binder 30, a plurality of sheets 11 of loose-leaf paper disposed between the first binder 20 and the second binder 30 and a coiled ring 10 fastening the first binder 20, each sheet 11 of loose-leaf paper, and the second binder 30.

The first binder 20 has an oblong hole 21 and a round hole 22.

The second binder 30 has an oblong slot 33 to match the oblong hole 21 of the first binder 20.

A pleated flap 31 is connected to the second binder 30.

The pleated flap 31 extends toward an inner face of the second binder 30.

The pleated flap 31 has a first crease 32 and a second crease 32'.

The pleated flap 31 is inserted in the oblong hole 21 of the first binder 20.

A first fastener 34 is disposed on the second binder 30.

A second fastener 39 is disposed on the pleated flap 31 to match the first fastener 34.

A connection plate 36 is disposed on the second binder 30.

A bag 35 is connected to the connection plate 36 to receive a pen 40.

The bag 35 has a third crease 37.

Figure 4:
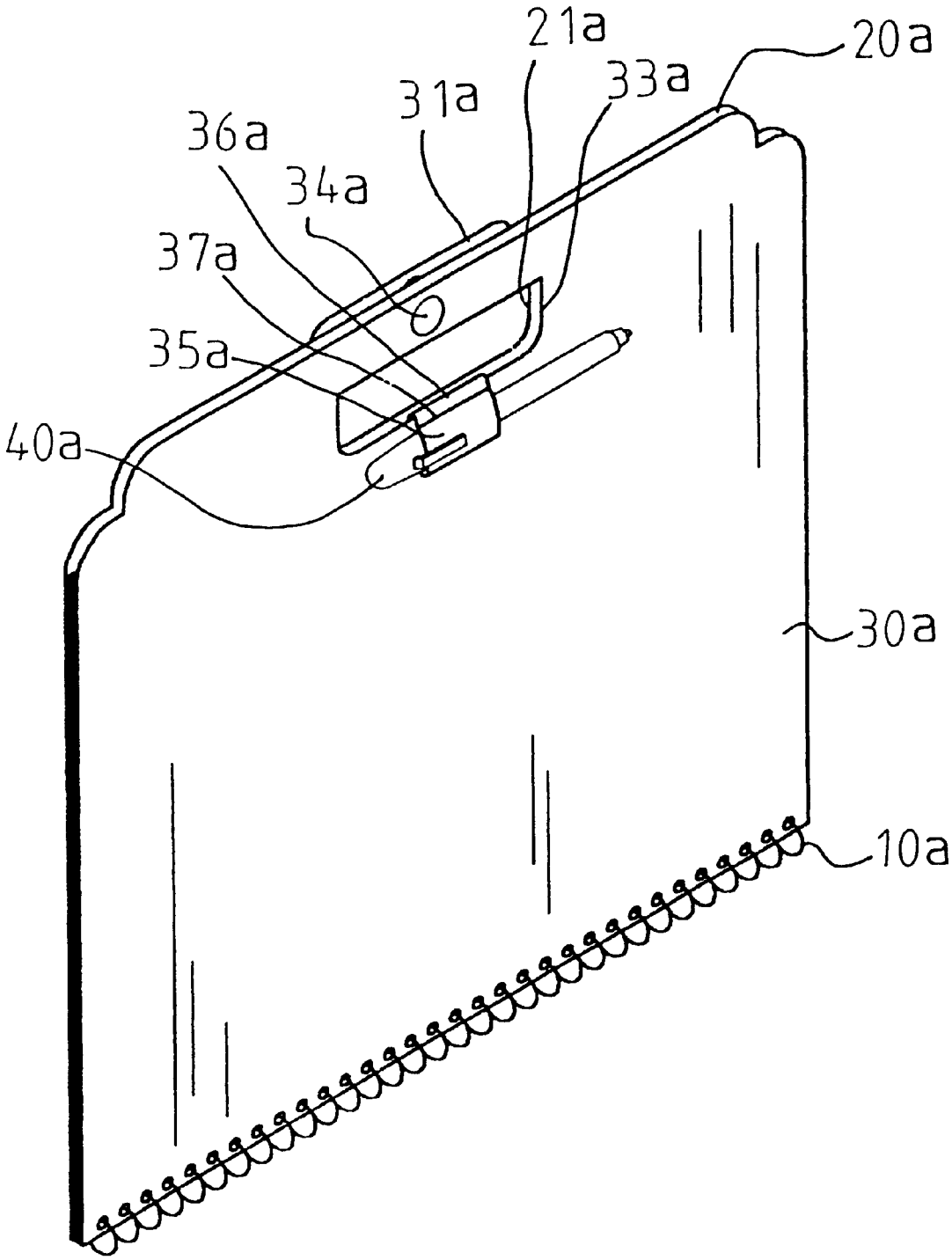
FIG. 4 is a perspective view of a loose-leaf binding device of a second preferred embodiment in accordance with the present invention while the loose-leaf binding device is closed.
Figure 5:
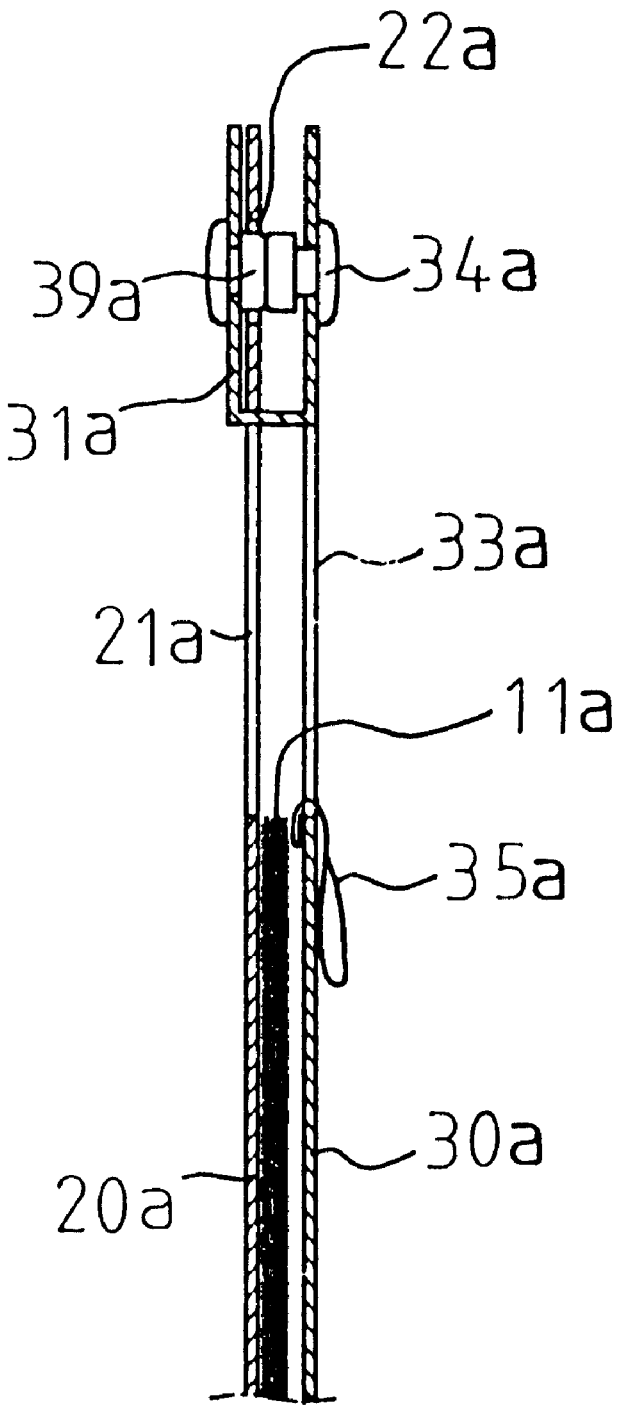
FIG. 5 is a sectional view of FIG. 4.

Referring to FIGS. 4 and 5, a second loose-leaf binding device comprises a first binder 20*a*, a second binder 30*a*, a plurality of sheets 11*a* of loose-leaf paper disposed between the first binder 20*a* and the second binder 30*a*, and a coiled ring 10*a* fastening the first binder 20*a*, each sheet 11*a* of loose-leaf paper, and the second binder 30*a*.

The first binder 20*a* has an oblong hole 21*a* and a round hole 22*a*.

The second binder 30*a* has an oblong slot 33*a* to match the oblong hole 21*a* of the first binder 20*a*.

A pleated flap 31*a* is connected to the second binder 30*a*.

The pleated flap 31*a* extends toward an outer face of the second binder 30*a*.

A first fastener 34*a* is disposed on the second binder 30*a*.

A second fastener 39*a* is disposed on the pleated flap 31*a* to match the first fastener 34*a*.

A connection plate 36*a* is disposed on the second binder 30*a*.

A bag 35*a* is connected to the connection plate 36*a* to receive a pen 40*a*.

The bag 35*a* has a crease 37*a*.

The invention is not limited to the above embodiment but various modification thereof may be made. Further, various changes in form and detail may be made without departing from the scope of the invention.

I claim:

1. A loose-leaf binding device comprises:

a first binder, a second binder, a coiled ring fastening the first binder and the second binder, the first binder having an oblong hole and a round hole, the second binder having an oblong slot to match the oblong hole of the first binder, a pleated flap connected to the second binder, the pleated flap having a first crease and a second crease, and wherein the pleated flap is inserted in the oblong hole of the first binder.

2. The loose-leaf binding device as claimed in claim 1, wherein a first fastener is disposed on the second binder and a second fastener is disposed on the pleated flap to match the first fastener.

3. The loose-leaf binding device as claimed in claim 2, wherein the pleated flap extends toward an inner face of the second binder.

4. The loose-leaf binding device as claimed in claim 2, wherein the pleated flap extends toward an outer face of the second binder.

5. The loose-leaf binding device as claimed in claim 1, wherein a connection plate is disposed on the second binder and a bag is connected to the connection plate.

* * * * *